US008235385B2

(12) United States Patent
Shimizu

(10) Patent No.: US 8,235,385 B2
(45) Date of Patent: Aug. 7, 2012

(54) IMAGE FORMING APPARATUS AND METHOD OF CONTROLLING IMAGE FORMING APPARATUS

(75) Inventor: Kiichirou Shimizu, Fujisawa (JP)

(73) Assignee: Ricoh Company, Limited, Tokyo (JP)

( * ) Notice: Subject to any disclaimer, the term of this patent is extended or adjusted under 35 U.S.C. 154(b) by 440 days.

(21) Appl. No.: 12/504,231

(22) Filed: Jul. 16, 2009

(65) Prior Publication Data

US 2010/0025926 A1 Feb. 4, 2010

(30) Foreign Application Priority Data

Jul. 30, 2008 (JP) ..... 2008-196212

(51) Int. Cl.
*B65H 5/00* (2006.01)

(52) U.S. Cl. ..... 271/225; 271/184; 271/288; 271/301

(58) Field of Classification Search ..... 271/225, 271/288, 184, 301
See application file for complete search history.

(56) References Cited

U.S. PATENT DOCUMENTS 4,727,398 A * 2/1988 Honjo et al. ..... 399/374
5,365,311 A * 11/1994 Matsuoka ..... 399/13
6,785,507 B2 * 8/2004 Asai et al. ..... 399/391
7,515,844 B2 4/2009 Tanaka et al.
7,536,121 B2 5/2009 Shimizu et al.
7,551,864 B2 6/2009 Fujimori et al.
2006/0204253 A1 * 9/2006 Mae et al. ..... 399/16
2007/0110457 A1 5/2007 Kato et al.
2007/0116480 A1 5/2007 Takeuchi et al.
2007/0116483 A1 5/2007 Kobayashi et al.
2009/0073247 A1 3/2009 Kaneko et al.

FOREIGN PATENT DOCUMENTS

JP 10-339975 12/1998
JP 2005-206264 8/2005
JP 2005-343661 12/2005
JP 2006-23544 1/2006

* cited by examiner

*Primary Examiner* — Michael McCullough
*Assistant Examiner* — Howard Sanders
(74) *Attorney, Agent, or Firm* — Oblon, Spivak, McClelland, Maier & Neustadt, L.L.P.

(57) ABSTRACT

An image forming apparatus and a method of controlling the image forming apparatus are provided. When a finisher is installed onto the image forming apparatus and a communication failure between the finisher and the image forming apparatus is detected, the image forming apparatus causes both of a post processing operation and a double-sided printing operation to be unavailable for selection by a user.

17 Claims, 5 Drawing Sheets

IMAGE FORMING APPARATUS AND METHOD OF CONTROLLING IMAGE FORMING APPARATUS

CROSS-REFERENCE TO RELATED APPLICATIONS

This patent application is based on and claims priority under 35 U.S.C. §119 to Japanese Patent Application No. 2008-196212, filed on Jul. 30, 2008, in the Japanese Patent Office, the disclosure of which is hereby incorporated herein by reference.

FIELD OF THE INVENTION

The present invention generally relates to an image forming apparatus attachable to or removable from a finisher, and more specifically to an image forming apparatus of in-body discharge type that is provided with a controller to manage operation of the image forming apparatus when the failure is detected in the finisher.

BACKGROUND

The recent image forming apparatus, such as a printer, copier, facsimile, or multifunctional apparatus, may be connected to or disconnected from a finisher that performs post processing such as sorting, binding, or punching onto a recording sheet that is output from the image forming apparatus.

The finisher, which may be optionally provided, may include a controller that controls post processing to be performed by the finisher. The controller may be further provided with a function of suppressing the damage or the inconvenience which may be caused when the finisher does not properly operate. For example, as described in the Japanese Patent Application Publication Nos. 2005-343661, 2005-206264, and 2006-023544, a sheet discharge tray or a paper delivery path may be switched when the failure is detected in the finisher.

However, there may be the case where the sheet discharge tray or the paper delivery path cannot be switched. For example, when the finisher having a sheet discharge tray is installed onto the image forming apparatus of in-body discharge type by mounting the finisher onto a sheet discharge section of the image forming apparatus, the recording sheet can be only output onto the sheet discharge tray of the finisher unless the finisher is removed from the sheet discharge section. In another example, when the finisher shares a paper delivery path with the image forming apparatus, the paper delivery path cannot be switched. In another example, even when the sheet discharge tray or the paper delivery path could be switched to another sheet discharge tray or paper delivery path, the image forming apparatus may not able to determine when to switch the sheet discharge tray or the paper delivery path unless there is an instruction from the finisher as the sheet discharge tray or the paper delivery path that is set by default is controlled by the controller of the finisher.

SUMMARY

Example embodiments of the present invention include an image forming apparatus including: an image forming device having an image forming section at which an image is formed on at least one side of a recording sheet; a first sheet discharge section through which the recording sheet transferred from the image forming section is output; a first sheet discharge surface configured to discharge thereon the recording sheet output from the inside of the image forming apparatus through the first sheet discharge section; a first switch back mechanism to switch the direction of the recording sheet transferred through the first sheet discharge section from the direction heading the outside of the image forming apparatus to the direction heading the inside of the image forming apparatus; and an open space provided above the first sheet discharge surface and accommodate therein a finisher so as to cover the first sheet discharge surface when the finisher is installed onto the image forming apparatus. The finisher includes: a switch back passage; a post processing passage that is separately provided from the switch back passage; and a second switch back mechanism to cause the recording sheet output from the first sheet discharge section to be conveyed to selected one of the switch back passage and the post processing passage according to an instruction for selecting one of the switch back passage and the post processing passage that is sent from the image forming apparatus. The image forming apparatus further includes a controller to send the instruction for selecting to the finisher to cause the second switch back mechanism of the finisher to select one of the switch back passage and the post processing passage according to a user instruction for performing an image forming job; and a peripheral device controller configured to detect a communication failure between the image forming apparatus and the finisher. When the communication failure is detected, the controller causes both of a post processing operation and a double-sided printing operation to be unavailable for selection by the user.

In addition to the above-described example embodiments, the present invention may be practiced in various other ways, for example, as a system including the above-described image forming apparatus and the finisher, a method of controlling the image forming apparatus, a storage medium storing the instructions to cause a processor to perform the method of controlling the image forming apparatus.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
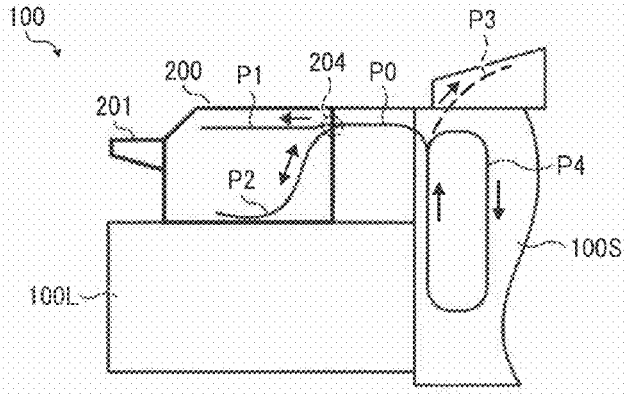
FIG. 1 is a schematic cross sectional diagram illustrating a path taken by a recording sheet which passes through the inside of a finisher attached to an image forming apparatus, according to an example embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION OF EXAMPLE EMBODIMENTS

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner.

Referring to FIGS. 1 to 7, an image forming apparatus 100 is explained according to an example embodiment of the present invention. The image forming apparatus 100 may be implemented by a multifunctional apparatus (MFP) capable of performing a plurality of functions including printing, copying, managing a document box such as transmitting or printing data stored in its internal memory, scanning, fax communication, and data communication. For the descriptive purpose, the image forming apparatus 100 may be referred to as the MFP 100. The MFP 100 may perform at least one of the plurality of functions according to an instruction received through an operation device 61 which is provided in the MFP 100. Alternatively, the MFP 100 may perform at least one of the plurality of functions according to an instruction received through a network from an external client apparatus or host apparatus.

Figure 4:
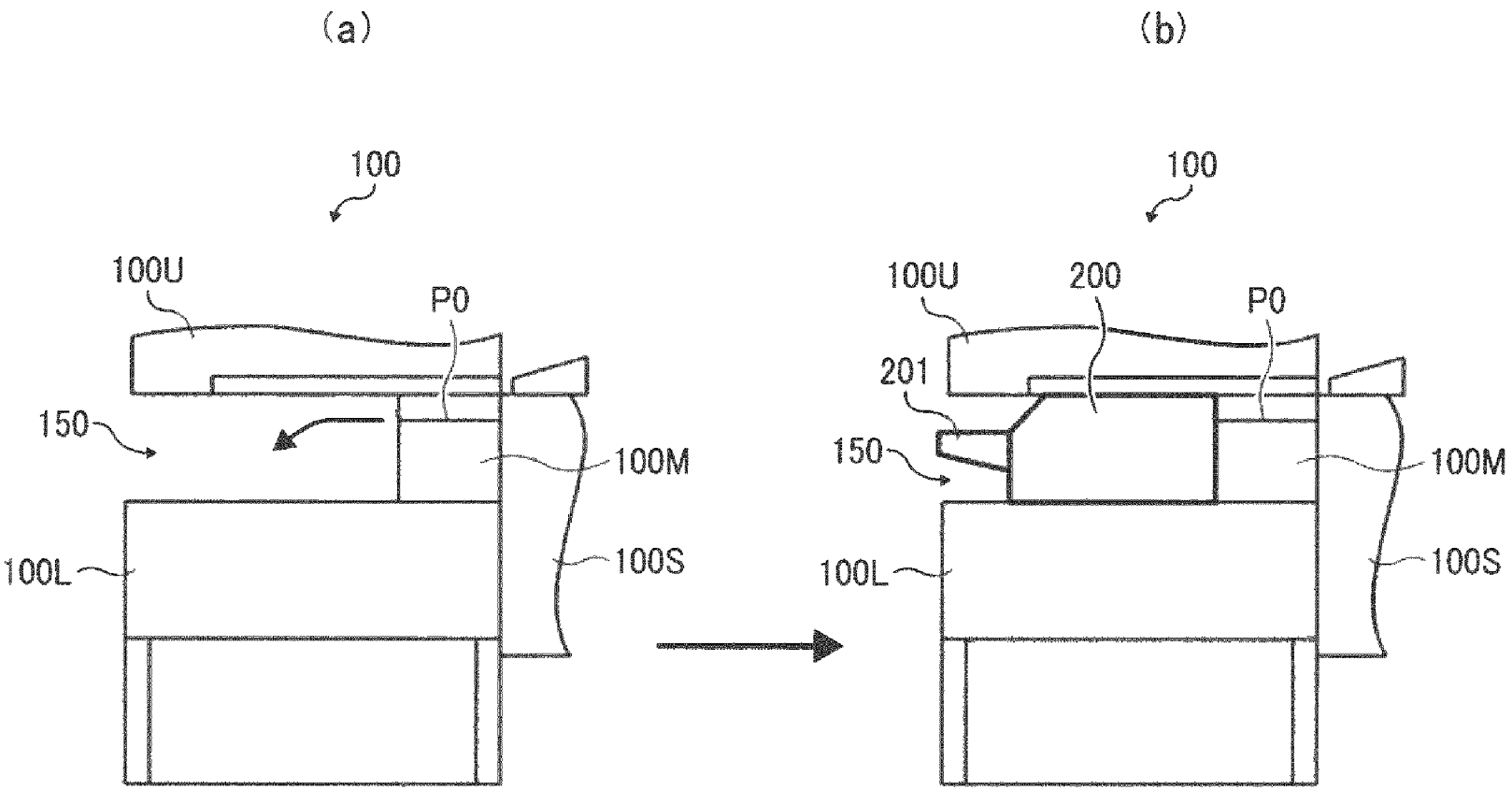
FIG. 4 is an illustration for explaining installment of the finisher of FIG. 1 onto the image forming apparatus of FIG. 1.
Figure 6:
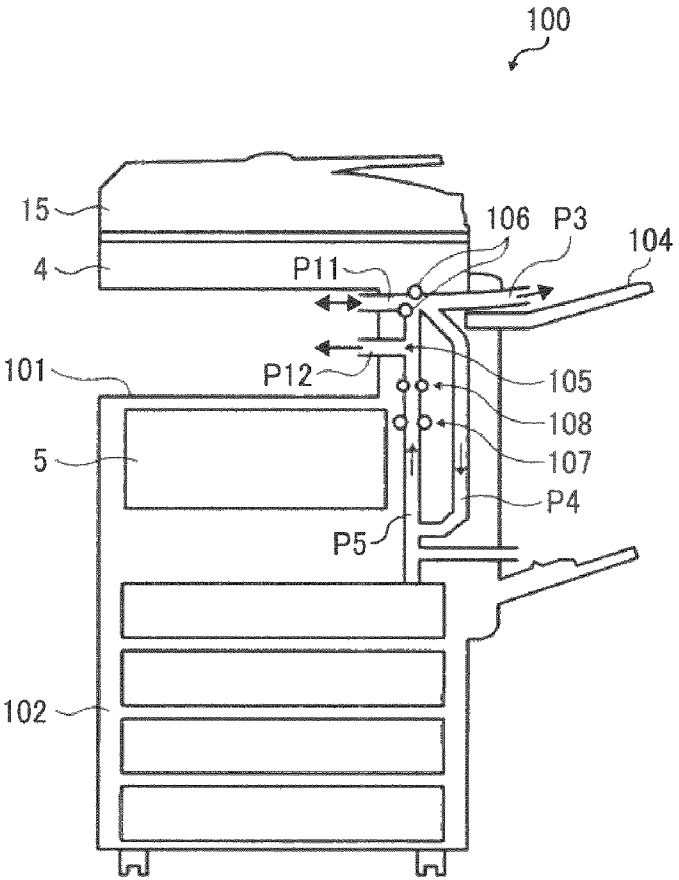
FIG. 6 is a schematic cross sectional diagram illustrating a path taken by a recording sheet which passes through the inside of the image forming apparatus of FIG. 1, when the finisher of FIG. 1 is not attached.
Figure 5:
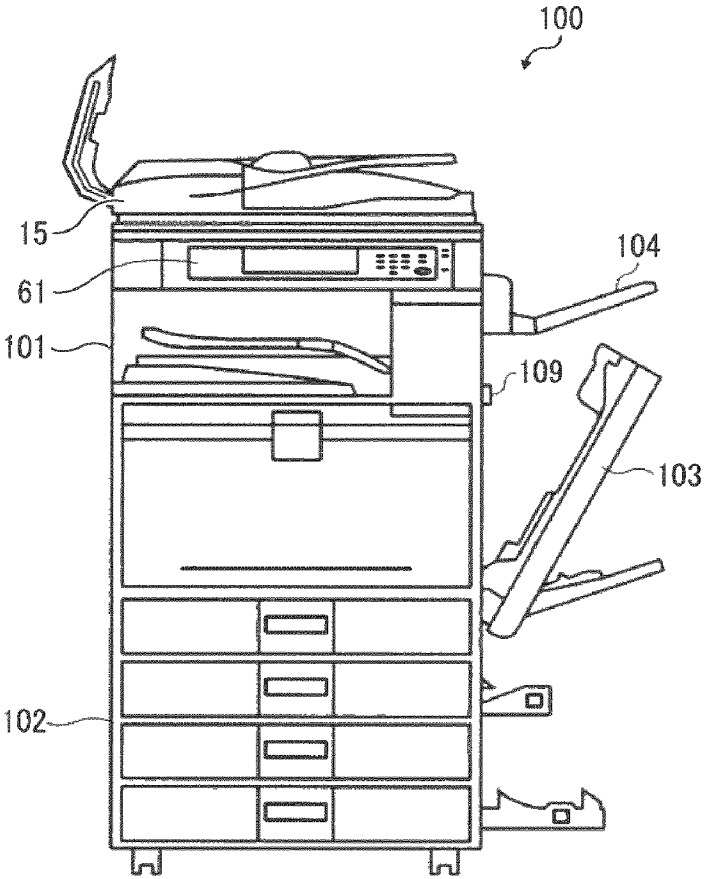
FIG. 5 a front side view illustrating the outer appearance of the image forming apparatus of FIG. 1, when the finisher of FIG. 1 is not attached.
Figure 7:
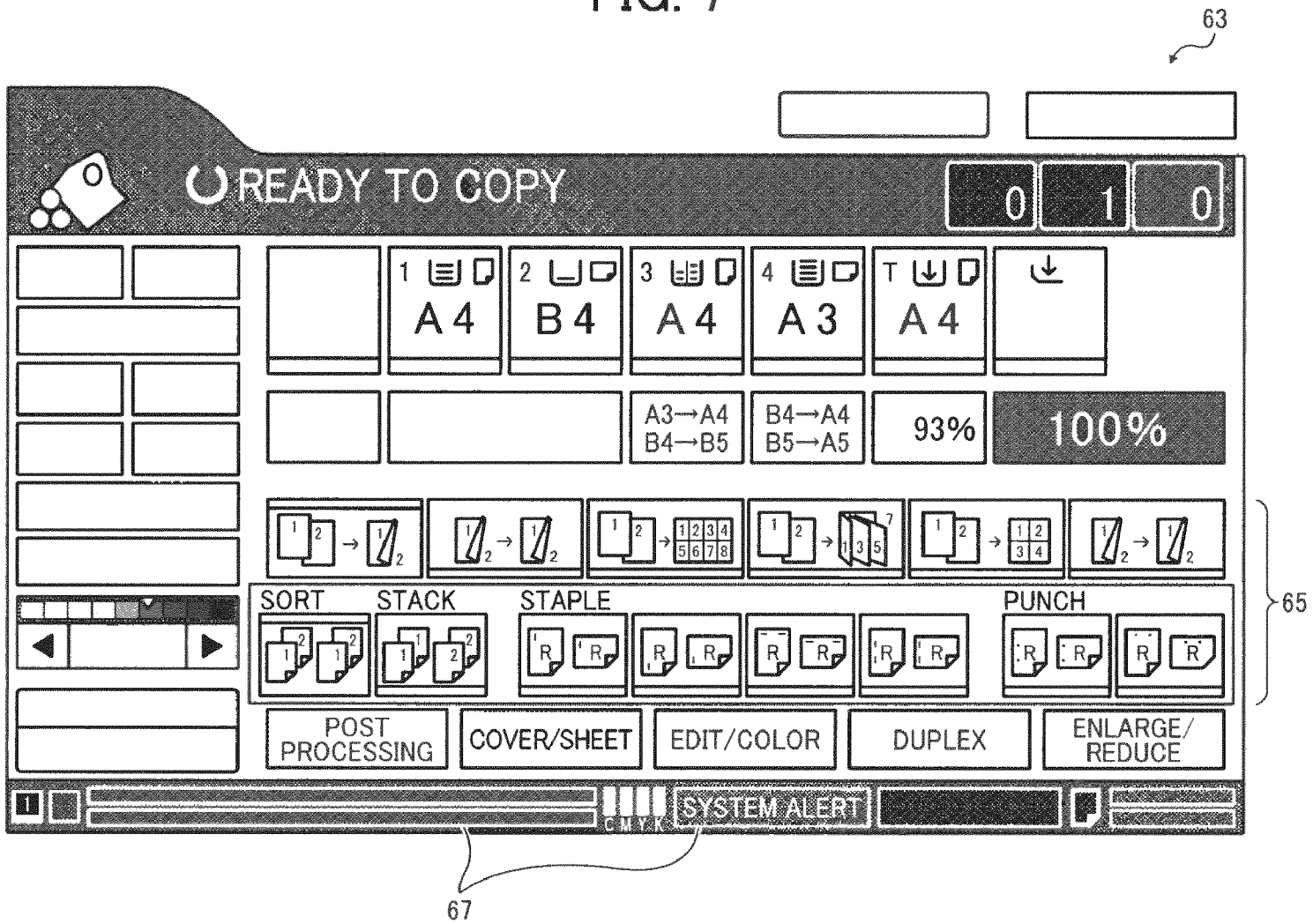
FIG. 7 is an illustration of an example screen displayed by the image forming apparatus of FIG. 1.

In this example, as illustrated in FIG. 4(*a*), the MFP 100 is the in-body discharge type apparatus having an upper section 100U, a lower section 100L, and the open space 150 placed between the upper section 100U and the lower section 100L. In this example, as illustrated in FIG. 5, the upper surface of the lower section 100L functions as a first sheet discharge tray 101 that receives the recording sheet output from the inside of the MFP 100 and holds the recording sheet in the open space 150. The upper section 100U may be provided with an image reading unit such as a scanner 4 and/or an automatic document feeder (ADF) 15. The ADF 15 may be optionally provided. As illustrated in FIG. 6, the lower section 100L may be provided with a sheet feeding device 102 including one or more sheet storage trays, one or more sheet feeding rollers, etc., and at least a portion of the image forming device 5 such as an optical writing device, a toner storage, a photoconductor, a charger, a cleaner, a primary transfer device such as a transfer belt, an image forming section 107 including a pair of rollers functioning as a secondary transfer device, etc. The MFP 100 may further include a section such as a connection section 100M and a linking section 100S each connecting the upper section 100U and the lower section 100L. The connection section 100M and the linking section 100S may include a portion of the image forming device 5 such as a fixing device 108 implemented by a pair of rollers, a sheet transfer device such as sheet discharge rollers, and a switch back mechanism including a switching device 105 and transfer rollers 106, etc., in the inside. The linking section 100S may be optionally provided with a second sheet discharge tray 104 to which the recording sheet being output from the inside of the MFP 100 is discharged. The linking section 100S is further provided with a door 103 (FIG. 5), which is opened to expose the inside of the MFP 100 and closed to cover the inside of the MFP 100.

In operation, when an instruction for copying an original document is received through the operation device 61, the scanner 4 reads the original document placed onto an exposure glass of the scanner 4 or fed by the ADF 15 to an image reading section of the scanner 4 into image data. Alternatively, the image data may be received from any other means, for example, from its internal memory or from the outside of the MFP 100 through a network. The image forming device 5 forms an image onto an image carrier such as the primary transfer device according to the image data generated by the scanner 4 or read from its internal memory. The image, such as a toner image, formed by the image forming device 5 is transferred to a recording sheet fed from one of the sheet storage trays of the sheet feeding device 102 at the image forming section 107. After the image is fixed by the fixing device 108, the recording sheet having the image thereon is output onto the first sheet discharge tray 101.

Referring to FIG. 6, the path that will be taken by the recording sheet is explained when the MFP 100 is instructed to perform one-side printing. The recording sheet, which is fed from one of the sheet storage trays of the sheet feeding device 102 included in the lower section 100L, is sent toward the image forming device 5 through a passage P5 provided in the linking section 100S. When the recording sheet reaches the image forming section 107, an image formed by the image forming device 5 is transferred onto one side of the recording sheet. The image formed on one side of the recording sheet is further fixed by the fixing device 108, which may be provided between the image forming section 107 and the switching device 105. The recording sheet having the image being fixed thereon is further transferred to the switching device 105 through the passage P5. In this example, the passage P5 is provided between the sheet feeding device 102 and the switching device 105. At this time, the switching device 105 is rotated counterclockwise so as to guide the recording sheet toward a first discharge passage P12, which is provided between the switching device 105 and the first sheet discharge tray 101. The recording sheet, which passes through the first discharge passage P12, is output onto the first sheet discharge tray 101 as indicated by the arrow of FIG. 6.

Still referring to FIG. 6, the path that will be taken by the recording sheet is explained when the MFP 100 is instructed to perform double-sided printing. The recording sheet, which is fed from one of the sheet storage trays of the sheet feeding device 102, is sent toward the image forming device 5 to receive an image on one side of the recording sheet in a substantially similar manner as described above. The recording sheet having the image fixed thereon, which is transferred through the passage P5, is further transferred to the position where the switching device 105 is provided. At this time, the switching device 105 is rotated clockwise so as to guide the recording sheet toward a switch back passage P11 through the transfer rollers 106. More specifically, the transfer rollers 106 are each rotated to cause the recording sheet to be transferred toward the outside of the MFP 100 through the switch back passage P11. In this example, an inner tray is provided, which forms the switch back passage P11 with the surface of the connection section 100M. The switch back passage P11 is thus a passage provided between the switching device 105 and the inner tray. When the trailing edge of the recording sheet is detected to be at the position near the transfer rollers 106, the transfer rollers 106 are caused to switch the direction of rotation to cause the recording sheet to transfer toward the inside of the MFP 100 through a double-sided printing passage P4 to the passage P5. The recording sheet is further transferred to the image forming section 107 to receive an image on the other side of the recording sheet. After the image is fixed by the fixing device 108, the recording sheet having the images formed on both sides is transferred to the first discharge passage P12 by the switching device 105. At this time, the switching device 105 is rotated so as to cause the recording sheet to be sent toward the first discharge passage P12. The recording sheet conveyed through the first discharge passage P12 is output onto the first sheet discharge tray 101.

Figure 2:
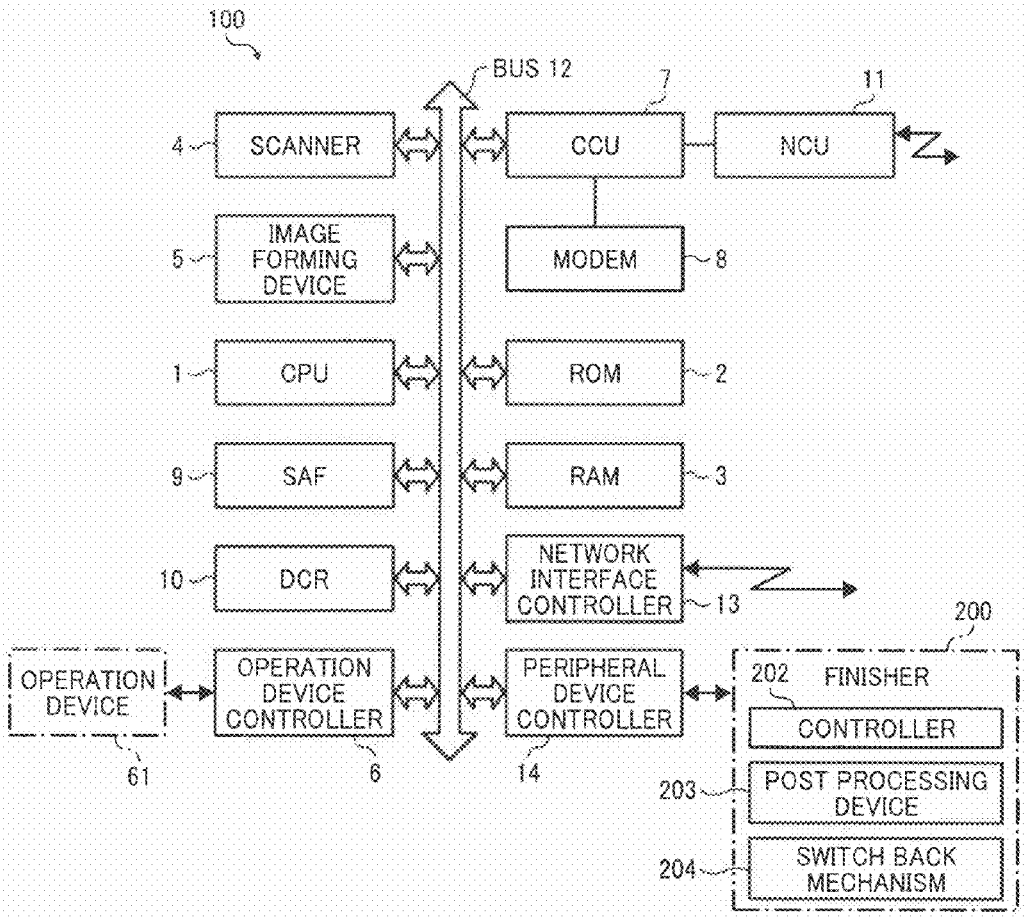
FIG. 2 is a schematic block diagram illustrating a structure of a control system of the image forming apparatus illustrated in FIG. 1 and a structure of the finisher illustrated in FIG. 1.

As illustrated in FIG. 4(*b*), the MFP 100 may be connected to a finisher 200, which may be optionally provided. As illustrated in FIG. 2, the finisher 200 includes a post processing device 203 capable of providing at least one of a plurality of post processing functions including sorting, binding, punching, and stapling. Referring back to FIG. 4(*b*). The finisher 200 may be placed onto the first sheet discharge tray 101 of the MFP 100 to which the recording sheet output from the MFP 100 is discharged so as to fit into the open space 150. Since the finisher 200 fits into the open space 150, the overall space required for the MFP 100 and the finisher 200 remains unchanged when compared with the case illustrated in FIG. 4(*a*) in which no finisher 200 is provided. The space can be thus efficiently used. In such case, since the first sheet discharge tray 101 of the MFP 100 is covered by the finisher 200, the recording sheet is output onto a sheet discharge tray 201 of the finisher 200 even when no post processing is performed by the finisher 200.

As illustrated in FIG. 1, the finisher 200 is provided with a post processing passage P1 which is taken by the recording sheet when post processing is performed, a switch back passage P2 through which the recording sheet to be switched back passes when performing double-sided printing, and a non-post processing passage which is taken by the recording sheet when no post processing is performed. Referring to FIG. 2, the finisher 200 further includes a sub controller 202 capable of controlling operation of the finisher 200 such as operation of selecting a passage to be taken by the recording sheet or operation of transferring the recording sheet through the selected passage, under control of the MFP 100. More specifically, the MFP 100 communicates with the sub controller 202 of the finisher 200 to control operation performed by the finisher 200. The sub controller 202 may be referred to as a finisher controller for the descriptive purpose. The sub controller 202 may be implemented by any desired processor provided with a memory.

When the double-sided printing is instructed, the MFP 100 causes the recording sheet having an image formed on its one side, which is output from the MFP 100 through the switch back passage P11, to switch back to the inside of the MFP 100 to cause the other side of the recording sheet to receive an image at the image forming section 107 as described above referring to FIG. 6. The finisher 200 is thus provided with the switch back passage P2 that is connected or that partly includes at least a portion of the switch back passage P11 of the MFP 100 through which the recording sheet to be switched back passes. In this example, the switch back passage P2 may function as the non-post processing passage.

FIG. 1 illustrates a plurality of passages taken by the recording sheet when the finisher 200 is attached to the MFP 100. For the descriptive purpose, in FIG. 1, the first discharge passage P12 and the switch back passage P11 of the MFP 100, each illustrated in FIG. 6, may be collectively referred to as a conveyance passage P0 of the MFP 100. In this example, the recording sheet output from the conveyance passage P0 is further transferred to one of the post processing passage P1 and the switch back passage P2 of the finisher 200, and output onto the sheet discharge tray 201 of the finisher 200. More specifically, the finisher 200 is provided with a switch back mechanism 204 that causes the recording sheet output from the MFP 100 to transfer to selected one of the switch back passage P2 and the post processing passage P1 under control of the finisher controller 202 according to an instruction received from the MFP 100. The switch back mechanism 204 may be provided at the position between the end of the conveyance passage P0 and the position where the post processing passage P1 and the switch back passage P2 meets. The switch back mechanism 204 of the finisher 200 may include a switching device that is similar in function to the switching device 105 of FIG. 6. The switch back mechanism may further include a transfer device, which may be implemented by a plurality of rollers, which transfers the recording sheet to the selected one of the post processing passage P1 and the switch back passage P2 when it is selected.

In one example, when the MFP 100 is instructed to perform one-side printing and post processing, the recording sheet having an image printed on its one side, which is output from the conveyance path P0, is caused to transfer through the post processing passage P1 for post processing under control of the finisher controller 202, and output onto the sheet discharge tray 201 of the finisher 200 after post processing.

Still referring to FIG. 1, in another example, when the MFP 100 is instructed to perform double-sided printing, the recording sheet output from the conveyance path P0 of the MFP 100 is caused to transfer through the switch back passage P2 of the finisher 200 that is connected to or partly includes at least the portion of the switch back passage P11, and sent back to the inside of the MFP 100 at a predetermined timing. The predetermined timing may be determined according to an instruction received from the MFP 100, for example, based on the detection of the trailing edge of the recording sheet as described above referring to FIG. 6. The recording sheet is sent back to the double-sided printing passage P4, and further to the image forming device 5. At the image forming section 107, the other side of the recording sheet receives the image formed by the image forming device 5. After the image is transferred onto the recording sheet, the recording sheet being transferred through the passage P5 and further through the conveyance passage P0 may be sent either to the post processing passage P1 for post processing or to the sheet discharge tray 201 of the finisher 200 through the non-post processing passage which is the switch back passage P2.

As described above referring to FIG. 1, when the finisher 200 is installed onto the MFP 100, the MFP 100 instructs the finisher 200 to cause the recording sheet output through the conveyance path P0 to be transferred to selected one of the post processing passage P1 and the switch back passage P2. The switching device of the switch back mechanism 204 of the finisher 200 may be rotated to cause the recording sheet to be transferred to the selected passage according to an instruction received from the MFP 100. More specifically, the finisher controller 202 controls operation of selecting the passage to which the recording sheet passes according to an instruction received from the MFP 100 through communication. For this reason, when the function of communicating with the MFP 100 does not properly operate, i.e., when there is the communication failure between the MFP 100 and the finisher 200, the finisher 200 may not properly operate even when the post processing device 203 properly operates. In order to suppress the damage or the inconvenience that may be caused due to the communication failure, in this example, the MFP 100 is provided with the function of controlling operation of the MFP 100 when the failure is detected in the finisher 200.

In this example, the MFP 100 further includes a main controller which controls failure operation when the failure is detected in the finisher 200. In one example, when one of a plurality of devices of the finisher 200 such as the post processing device 203, a transfer device such as the transfer device of the switch back mechanism 204, and the switching device of the switch back mechanism 204 does not properly operate, any device other than the device in which the failure is detected may be used, allowing a part of the functions of the finisher 200 to be available for use by the user. For example, even when the failure is detected in the post processing device 203, the switch back mechanism 204 may be used without being influenced by the failure in the post processing device 203. More specifically, in this example, the finisher 200 may be provided with a detector device, which detects the failure that is occurred in the finisher 200. As long as the finisher 200 is communicable with the main controller of the MFP 100, the finisher 200 may send notification to the MFP 100 based on a detection result output by the detector device. Based on the detection result received from the finisher 200, the MFP 100 may notify the user while providing information indicating the type of failure, one or more functions that are not available for use due to the failure, or possible actions that the user can take. By providing such information, the user at the MFP 100 may be able to determine what actions to be taken next, or the user may be allowed to instruct the MFP 100 to perform desired operation.

In another example, when communication between the main controller of the MFP 100 and the finisher controller 202 of the finisher 200 does not properly operate, the finisher 200 cannot be used as there is no information that can be exchanged between the MFP 100 and the finisher 200 for controlling operation of the finisher 200. Further, the MFP 100 is not provided with any notification or the detection result from the finisher 200 due to the communication failure. Even in such case, the MFP 100 in this example is capable of notifying the user while providing information indicating the type of failure, one or more functions that are not available for use due to the failure, or possible actions that the user can take. By providing such information, the user at the MFP 100 may be able to determine what actions to be taken next, or the user may be allowed to instruct the MFP 100 to perform desired operation even when the communication failure is detected. In this manner, the damage, such as the inconvenience, which may be caused to the communication failure may be suppressed. Further, the performance level of the MFP 100 may be kept sufficiently high.

Figure 3:
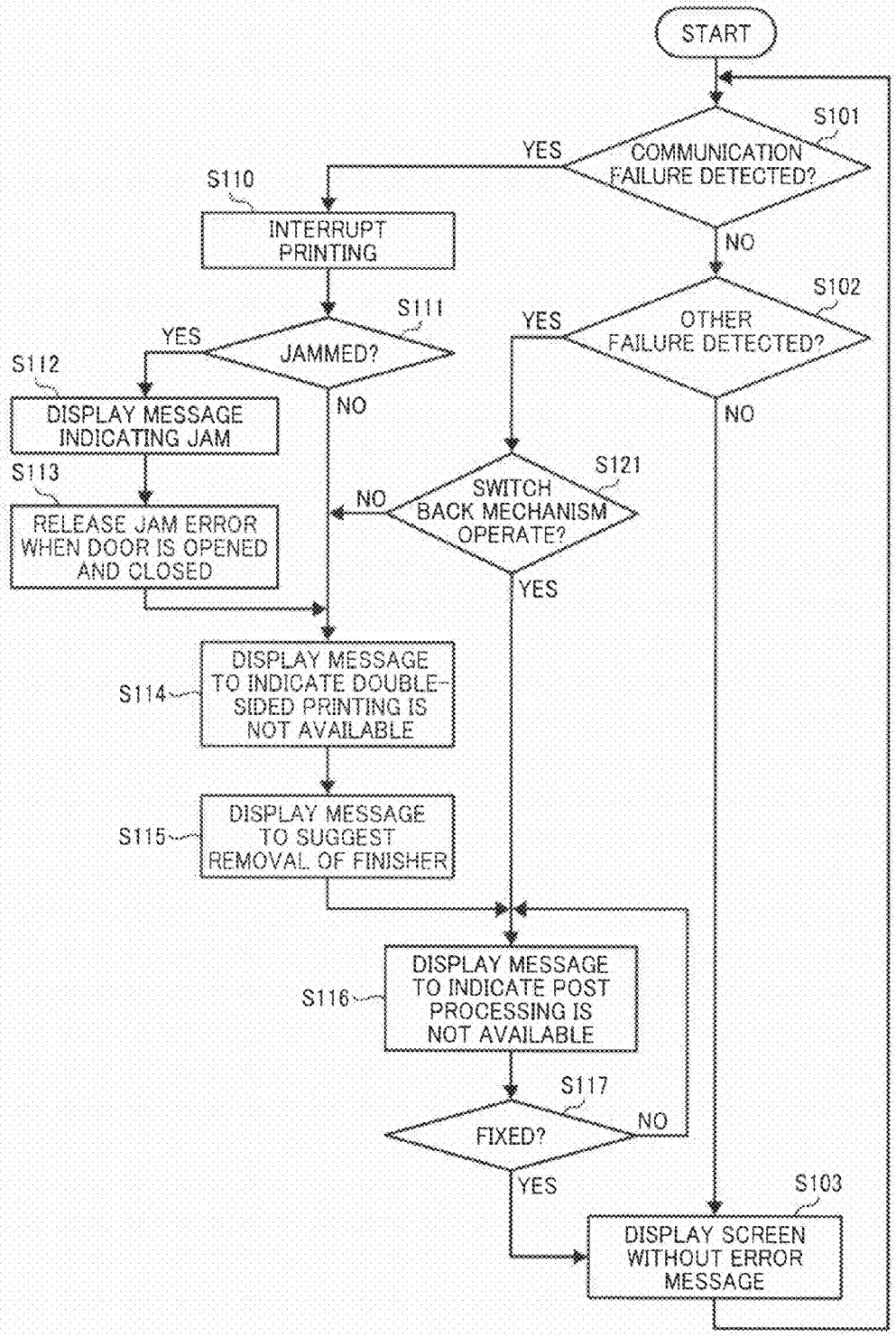
FIG. 3 is a flowchart illustrating operation of controlling operation of the image forming apparatus of FIG. 1, performed by the control system of FIG. 2, according to an example embodiment of the present invention.

Referring now to FIGS. 2 and 3, operation or system of controlling the function of providing the user with information regarding the failure in the finisher 200 when such failure is detected in the finisher 200 is explained according to an example embodiment of the present invention.

<Control System of MFP 100>

Referring to FIG. 3, a structure of a control system of the MFP 100 is explained according to an example embodiment of the present invention. The MFP 100 includes a central processing unit (CPU) 1, a read only memory (ROM) 2, a random access memory (RAM) 3, the scanner 4, the image forming device 5 including the plotter, an operation device controller 6, a communication controller unit (CCU) 7, a modem 8, a store and forward (SAF) memory 9, an encoder/decoder (DCR) 10, a network control unit (NCU) 11, a network interface controller 13, and a peripheral device controller 14, which are connected through a bus 12.

The CPU 1 is implemented by any desired processor capable of controlling operation of each device provided in the MFP 100 according to software program, which may be stored in the ROM 2. The ROM 2 is implemented by any memory device, which stores various software programs to be used by the CPU 1. The RAM 3 functions as a work area of the CPU 1, for example, when performing the operation according to the software program stored in the ROM 2. Alternatively, the RAM 3 may function as a memory device to be used by the CPU 1 to store data at least temporarily. The CPU 1, the ROM2, and the RAM 3 may be collectively referred to as a system controller of the MFP 100, which is referred to as the main controller of the MFP 100 described above.

The various programs to be stored in the ROM 2 or any storage device or medium such as a hard disk drive (HDD) may include a finisher control program, which may be activated when the finisher 200 is attached to check whether the failure is detected in the finisher 200 and to control operation of the MFP 100 when such failure is detected. When the CPU 1 loads the finisher control program, preferably with control data, from the storage device or medium onto the RAM 3 for activation, the CPU 1 may perform operation of controlling the MFP 100 according to the failure detected in the finisher 200, for example, as described below referring to FIG. 3.

Further, according to various programs, the system controller of the MFP 100 may control at least one of a plurality of devices including the scanner 4, the image forming device 5, the operation device controller 6, the communication controller unit (CCU) 7, the store and forward (SAF) memory 9, the encoder/decoder (DCR) 10, the network interface controller 13, and the peripheral device controller 14. The data may be exchanged among the plurality of devices, for example, through the bus 12.

The scanner 4 is a device, which reads an original document into image data, for example, in the bitmap format. The image forming device 5 forms an image according to the image data generated by the scanner 4. Alternatively, the image data may be received from the outside device through facsimile communication or network communication, or from the internal memory of the MFP 100. The image forming device 5 is provided with the switch back mechanism, which switches back the recording sheet for double-sided printing and a transfer device for conveying the recording sheet through the selected passage. The operation device 6 may be implemented by a liquid crystal display (LCD) having the touch panel screen, which allows the user to input a user instruction such as a job request or outputs information such as information regarding the MFP 100 or the job status to the user.

The CCU 7 controls a communication device such as the modem 8 which modules a signal to be transmitted or demodulates a signal that is received, or the network control unit (NCU) 11 that controls the communication network. Through control of the communication device, the CCU 7 exchanges a facsimile control signal with a counterpart apparatus to allow facsimile communication.

The SAF memory 9 functions as a storage device which stores image data, which may be received through the CCU 7 or the network interface controller 13.

The DCR 10 encodes the image data according to a predetermined coding technique, or decodes the coded image data. The image data may be encoded, for example, before storing the image data onto the storage device or before sending the image data to another apparatus.

The network interface controller 13 controls the network in compliance with the Ethernet or the wireless local area network (LAN).

The peripheral device controller 14 is implemented by any device which exchanges a control signal for controlling a peripheral device. In this example, the peripheral device controller 14 functions as an interface with the finisher controller 202 provided in the finisher 200, which may be optionally attached to the MFP 100.

<Control When Failure in Finisher is Detected>

Referring to FIG. 3, controlling operation to be performed by the MFP 100, performed by the system controller of the MFP 100, is explained according to an example embodiment of the present invention.

For the descriptive purpose, in this example, it is assumed that the system controller of the MFP 100 determines that the failure is detected in the finisher 200 when communication with the finisher 200 through the peripheral device controller 14 does not properly operate, or when at least one of a plurality of devices including the post processing device 203 or the switch back mechanism 204 of the finisher 200 does not property operate.

The system controller of the MFP 100 monitors whether such failure is detected, and when detected, notifies the user through the LCD of the operation device 61 with information indicating the type of failure, one or more functions that is not available for use, or one or more actions that the user can take.

Referring to FIG. 3, at S101, the system controller of the MFP 100 determines whether there is any communication failure that is detected for communication with the finisher 200. The peripheral device controller 14 is capable of controlling the peripheral device such as the finisher 200. According to an instruction from the system controller, the peripheral device controller 14 controls the finisher 200 that is connected to the MFP 100, for example, through exchanging data such as data that indicates the operation status of the finisher 200. For example, the peripheral device controller 14, which has the function of communicating, is provided with a function of detecting any communication failure. By checking data, or the detection result, sent from the peripheral device controller 14, the system controller may be able to determine whether there is any communication failure with the finisher 200.

When there is no communication failure ("NO" at S101), the operation proceeds to S102. When there is any communication failure ("YES" at S101), the operation proceeds to S110.

At S102, the system controller determines whether there is any failure being detected in any one of the plurality of devices that relates to the function or operation provided by the finisher 200. For example, the failure may relate to any failure that may be caused in the post processing device 203 or the switch back mechanism 204 of the finisher 200. The failure relating to the post processing operation or the switch back operation may be detected by a detector, which may be provided in the finisher 200 to detect the operation performed by the post processing device 203 or the switch back mechanism 204. When the detector outputs a detection result indicating that the failure is caused in the post processing device 203 or the switch back mechanism 204 of the finisher 200, the system controller of the MFP 100 receives the detection result through the peripheral device controller 14. In this example, the finisher 200 is provided with a post processing device detector which detects whether any failure is caused in the post processing device 203 to output a detection result, and a switch back mechanism detector which detects whether any failure is caused in the switch back mechanism 204 to output a detection result. The system controller of the MFP 100 may receive the detection results at any desired time through the peripheral device controller 14. For example, the switch back mechanism detector may send a specific code indicating the status of the switch back mechanism 204 to the peripheral device by communication. Based on the specific code, the peripheral device controller 14 may send notification to the system controller of the MFP 100.

When it is determined that there is no other failure detected ("NO" at S102), the operation proceeds to S103 to display a screen on the operation panel 61, which allows the user to input a job such as a printing job including a post processing job, and the operation ends. With the display of the screen that allows the user to request the post processing job, the user can recognize that the finisher 200 properly operates. After S103, the MFP 100 may perform S101 to keep monitoring to perform the operation of FIG. 3.

When it is determined that there is any communication failure that is detected at S101 ("YES" at S101), the operation proceeds to S110 to stop the printing operation if the printing operation is being performed.

When the printing job indicates that the double-sided printing is to be performed, the system controller of the MFP 100 causes the leading edge of the recording sheet to stop at a position in the conveyance path P0 before the recording sheet enters the switch back passage P2 from the conveyance path P0, for example, by controlling the transfer rollers 106. Alternatively, when the recording sheet has been entered the switch back passage P2, the system controller of the MFP 100 may cause the recording sheet to be switched back toward the inside of the MFP 100 using the transfer rollers 106 until the trailing edge reaches the position entering the switch back passage P2. By keeping the edge of the recording sheet at the entry of the switch back passage P2, the damage which may be otherwise caused due to the communication failure, may be suppressed. Further, the recording sheet may be easily removed out of the MFP 100 by opening the door 103 (FIG. 5) in case when it is jammed.

The system controller of the MFP 100 may additionally cause the supply of the electric power to at least one of the plurality of devices provided in the finisher 200. Since operation, such as post processing operation, performed by the finisher 200 is not performed when there is the communication failure, the supply of the electric power may be stopped to save the energy while not affecting the printing operation.

At S111, the system controller of the MFP 100 determines whether there is any recording sheet that is conveyed, which has been jammed, in the double-sided printing passage P4. For example, the MFP 100 may be provided with a detector which detects whether the recording sheet is jammed in the double-sided printing passage P4. Alternatively, the system controller assumes that the recording sheet is jammed when the double-sided printing job is performed after the communication failure has been detected.

When it is determined that there is the recording sheet that has been jammed ("YES" at S111), the operation proceeds to S112. When it is determined that there is no recording sheet that has been jammed ("NO" at S111), the operation proceeds to S114.

At S112, the system controller of the MFP 100 causes the LCD of the operation panel 61 to display a screen, which indicates that there is the communication failure that is detected and further indicates that the recording sheet is jammed in the switch back mechanism of the MFP 100. For example, the operation panel 61 may display a screen, which includes a message that requests the user to check for the recording sheet that is jammed, or to remove the recording sheet that is jammed, by opening the door 103.

When the double-sided printing job is to be performed, and when the communication failure occurs, the system controller of the MFP 100 stops the double-sided printing operation being performed as described above referring to S110. However, even when the double-sided printing job cannot be performed due to the communication failure, the MFP 100 is able to perform printing operation as long as the finisher 200 is not required. In order to cause the MFP 100 to receive a printing job which does not require the use of the finisher 200, the recording sheet that is jammed needs to be removed.

In such case, the user may open a door of the finisher 200, and removes the recording sheet that is jammed out from the finisher 200 or the MFP 100 through the opened door. However, even when the recording sheet is removed and the door of the finisher 200 is closed, the system controller of the MFP 100 is not able to determine whether the recording sheet is removed since the MFP 100 cannot communicate with the finisher 200 due to the communication failure. In order to notify the MFP 100, the power of the MFP 100 needs to be turned off and on to restart the system controller of the MFP 100 to receive another printing job.

In view of the above, in this example, at S113, when the system controller of the MFP 100 detects that there is the communication failure at S101, the system controller of the MFP 100 is caused to recognize that the jammed recording sheet is removed from the double-sided printing passage P4 when the door 103 of the MFP 100 is opened and closed, without requiring the user to turn off the power of the MFP 100. More specifically, in this example, the MFP 100 is provided with a detector 109 (FIG. 5) that detects opening or closing of the door 103 that is opened by the user to remove the recording sheet that is jammed from the double-sided printing passage P4. Based on the detection result output from the detector 109, the system controller of the MFP 100 determines that the recording sheet that is jammed is removed. At this time, the screen of the operation panel 61 may be switched to notify the user that the jammed recording sheet is removed, for example, by not displaying the notification message that is previously displayed.

Further, since the finisher 200 is not in operation, the MFP 100 needs to change the place to which the recording sheet is output as the sheet discharge tray 201 of the finisher 200 is not available for use. When the MFP 100 is only provided with one sheet discharge section such as the first sheet discharge tray 101, the first sheet discharge tray 101 is not switched to another sheet discharge tray. In such case, as described below, the MFP 100 notifies the user to remove the finisher 200.

When it is determined that the recording sheet is not jammed ("NO" at S111), the operation proceeds to S114, without performing S112 and S113.

At S114, the system controller of the MFP 100 causes the LCD of the operation panel 61 to display a screen, which indicates that the double-sided printing cannot be performed. For example, the operation panel 61 may display a screen illustrated in FIG. 7, which displays a message indicating that the double-sided printing cannot be performed.

At S115, the operation panel 61 causes the screen that is displayed at S114 to additionally indicate that the double-sided printing can be performed if the finisher 200 is removed from the MFP 100. As described above referring to FIGS. 1 and 2, the MFP 100 can perform double-sided printing using the switch back mechanism provided in the MFP 100 even when the finisher 200 is not provided. In such case, the recording sheet is conveyed from the double-sided printing passage P4 through the conveyance path P0 onto the first sheet discharge tray 101 provided on the surface of the lower section 100L. As long as the finisher 200 is taken out from the space 150, the MFP 100 can perform the double-sided printing as the first sheet discharge tray 10 is not covered by the finisher 200 and the selection of the passage performed by the finisher 200 is not necessary.

At S116, the system controller of the MFP 100 causes the LCD of the operation panel 61 to notify the user that the post processing operation is not available as the finisher 200 is not in operation. For example, the operation panel 61 may display a screen, which notifies the user that the finisher 200 is not in operation, for example, by displaying a message indicating that the post processing operation provided by the finisher is not available for use.

In this example, S114, S115, and S116 may be performed at the same time, for example, by displaying the message indicating that the double-sided printing is not available as described referring to S114, the message indicating that the finisher 200 should be removed if the user desires to use the double-sided printing function as described referring to S115, and the message indicating that the post processing operation is not available for use as described referring to S116, onto one screen at the same time, for example, as one message. With this message, the user can instantly recognize the availability of each function or the activity that the user is required to take. For example, the LCD of the operation device 61 may display a screen 63 of FIG. 7, which includes a section 67 that displays the message indicating that the double-sided printing and the post processing are not available. Alternatively or additionally, a section 65, which indicates various printing operations and post processing operations that are available for use, may be changed such that the double-sided printing and the post processing options are not displayed. With this display, the user is prevented from selecting the double-sided printing as well as the post processing.

Referring back to S101, when it is determined that the communication failure is not detected ("NO" at S101), the operation proceeds to S102 to determine whether there is any other failure that is detected. When it is determined that any other failure is not detected ("NO" at S102), the operation proceeds to S103. When it is determined that there is the other failure that is detected ("YES" at S102), the operation proceeds to S121 to determine whether the switch back mechanism 204 of the finisher 200 properly operates. When it is determined that the switch back mechanism 204 is in operation ("YES" at S121), the operation proceeds to S116.

At S116, the system controller of the MFP 100 determines that the double-sided printing can be performed by the finisher 200. For this reason, the operation panel 61 is caused to display a screen, which indicates that the post processing is not available, but not to display any message indicating that the double-sided printing is not available. For example, the screen may include a message notifying the user that the post processing is not available while providing various options that uses the double-sided printing.

When it is determined that there is the other failure detected at S102 ("YES" at S102) and when it is determined that the switch back mechanism 204 of the finisher 200 does not properly operate ("NO" at S121), the system controller of the MFP 100 determines that the double-sided printing cannot be performed in addition to the post processing. In this example, since the switching device of the switch back mechanism 204 needs to be in operation in order to cause the recording sheet to be transferred to the passage where the post processing device 203 is provided, the system controller of the MFP 100 is caused to make the post processing device 203 unavailable for use when the switch back mechanism 204 does not properly operate regardless of whether the post processing device 203 properly operates or not.

More specifically, in this example, when it is determined that the switch back mechanism 204 does not properly operate, S114, S115, and S116 may be performed at the same time, for example, by displaying the message indicating that the double-sided printing is not available as described referring to S114, the message indicating that the finisher 200 should be removed if the user desires to use the double-sided printing function as described referring to S115, and the message indicating that the post processing operation is not available for use as described referring to S116, onto one screen at the same time, for example, as one message. With this message, the user can instantly recognize the availability of each function or the activity that the user is required to take.

At S117, the system controller of the MFP 100 determines whether the failure caused in the post processing device 203 or the switch back mechanism 204 is fixed. When it is determined that the failure is fixed ("YES" at S117), the operation proceed to S103. When it is determined that the failure is not fixed ("NO" at S117), the operation repeats S116.

At S103, the system controller of the MFP 100 switches the display displayed on the LCD of the operation panel 61 to a screen, which indicates that the finisher 200 properly operates, for example, by not displaying the error message. At this time, the system controller of the MFP 100 starts supplying the electric power to the finisher 200.

As described above, the MFP 100 is capable of switching the screen, or the message, to be displayed to the user according to the communication failure that may be caused with the finisher 200, the failure in the post processing device 203 of the finisher 200, or the failure in the switch back mechanism 204 of the finisher 200. With this function, the user can instantly recognize the type of failure that is caused in the finisher 200, and further perform operation that is needed to use a desired function. Even when the finisher 200 does not properly operate, the MFP 100 allows the user to use a plurality of functions that is available for use by the MFP 100, thus suppressing the damage or inconvenience while keeping the performance level relatively high.

More specifically, even when there is the communication failure such that the communication cannot be performed between the finisher 200 and the MFP 100, the system controller of the MFP 100 may automatically switch the path to be taken by the recording sheet when a user instruction for performing a double-sided printing operation is received based on the determination that the finisher 200 is not in operation. For example, the system controller of the MFP 100 may cause the recording sheet to transfer to the passage P3 that is different from the passage P12 set by default, and further cause the recording sheet to output through the second sheet discharge tray 104. With this function, the user is able to perform the desired operation, which is available for use by the MFP 100, even without realizing that the finisher 200 does not properly operate.

Even when there is no alternate path or sheet discharge tray, the system controller of the MFP 100 does not allow the user to select a post processing operation and a double-sided printing operation. Further, the system controller of the MFP 100 may cause the LCD of the operation device 61 to display a message that suggests the user to remove the finisher 200. With this function, the user can instantly recognize the actions that the user is required to take in order to perform the desired operation.

The operation of FIG. 3 may be performed in various other ways. For example, S115 of FIG. 3 does not have to be performed, for example, when the MFP 100 is provided with the second sheet discharge tray 104. More specifically, as illustrated in FIG. 1, the system controller of the MFP 100 may cause the recording sheet to convey from the double-sided printing passage P4 toward a second sheet discharge passage P3 to output the recording sheet onto the second sheet discharge tray 104 when the second sheet discharge tray 104 is available.

Numerous additional modifications and variations are possible in light of the above teachings. It is therefore to be understood that within the scope of the appended claims, the disclosure of the present invention may be practiced otherwise than as specifically described herein.

With some embodiments of the present invention having thus been described, it will be obvious that the same may be varied in many ways. Such variations are not to be regarded as a departure from the spirit and scope of the present invention, and all such modifications are intended to be included within the scope of the present invention.

For example, elements and/or features of different illustrative embodiments may be combined with each other and/or substituted for each other within the scope of this disclosure and appended claims.

In the above-described example, the switch back mechanism 204 of the finisher 200 may be additionally provided with a device that is similar in function to the transfer rollers 106 of FIG. 6. In such case, when the finisher 200 is not connected to the MFP 100, the MFP 100 switches back the recording sheet using the switch back mechanism provided in the MFP 100 to perform double-sided printing. When the finisher 200 is connected to the MFP 100, the finisher 200 switches back the recording sheet using the switch back mechanism 204 provided in the finisher 200.

In another example, the MFP 100 may notify the user in various ways other than displaying through the LCD of the operation device 61. For example, when the user is remotely located from the MFP 100, the MFP 100 may send notification to a client apparatus operated by the user.

Further, as described above, any one of the above-described and other methods of the present invention may be embodied in the form of a computer program stored in any kind of storage medium. Examples of storage mediums include, but are not limited to, flexible disk, hard disk, optical discs, magneto-optical discs, magnetic tapes, involatile memory cards, ROM (read-only-memory), etc.

Alternatively, any one of the above-described and other methods of the present invention may be implemented by ASIC, prepared by interconnecting an appropriate network of conventional component circuits or by a combination thereof with one or more conventional general purpose microprocessors and/or signal processors programmed accordingly.

In one example, the present invention may reside in an image forming apparatus, comprising: a plotter configured to perform a printing operation by forming an image on a recording sheet; a sheet feeder device configured to convey the recording sheet to the plotter; a sheet discharge section configured to convey and discharge the recording sheet received from the plotter; a first switch back mechanism configured to switch back the recording sheet received from the sheet discharge section and to convey the recording sheet that is switched back to the plotter when double-sided printing is performed; a controller configured to control each of a plurality of devices of the image forming apparatus including the plotter, the sheet feeder device, and the sheet discharge section; a space configured to hold the recording sheet discharged from the sheet discharge section and configured to accommodate therein a finisher when the finisher is attached to a body of the image forming apparatus, wherein the finisher is attachable to or removable from the body of the image forming apparatus and includes: a second switch back mechanism configured to switch back the recording sheet received from the sheet discharge section and to convey the recording sheet that is switched back to the plotter; and a post processing device configured to perform post processing under control of the controller of the image forming apparatus; and a first detector configured to detect communication failure between the image forming apparatus and the finisher to output a detection result. The controller of the image forming apparatus includes: a controller configured to operate the second switch back mechanism of the finisher according to a request for performing double-sided printing when the finisher is attached to the image forming apparatus, and to operate the first switch back mechanism of the image forming apparatus according to a request for performing double-sided printing when the finisher is not attached to the image forming apparatus; and a controller configured to interrupt the printing operation when the detection result indicating that the communication failure occurs is received from the first detector, and to notify a user that the post processing operation and the double-sided printing operation are not available for use.

In the above-described example, the image forming apparatus further includes: a cover open/close detector configured to detect the opening or closing of a cover that covers a double-sided printing mechanism. When the cover open/close detector detects the opening or closing of the cover after the first detector outputs the detection result indicating that the communication failure occurs, the controller is configured to resume the printing operation that is interrupted, and to cause the recording sheet received from the sheet discharge section to be conveyed through a transfer mechanism to a second sheet discharge section without being conveyed through the finisher.

In the above-described example, the image forming apparatus further includes: a controller configured to notify the user that the finisher needs to be removed from the image forming apparatus to perform the double-sided printing when the first detector outputs the detection result indicating that the communication failure occurs.

In the above-described example, the image forming apparatus further includes: a controller configured to control operation of the second switch back mechanism to cause the recording sheet to be at a predetermined position when the printing operation is interrupted.

In the above-described example, the image forming apparatus further includes: a controller configured to stop the supply of an electric power to the post processing device when the printing operation is interrupted.

In the above-described example, the image forming apparatus further includes: a second detector configured to detect the failure caused in the second switch back mechanism, wherein when the second detector outputs a detection result indicating that the failure occurs in the second switch back mechanism, the controller is configured to notify the user that the double-sided printing is not available for use and that the finisher needs to be removed from the image forming apparatus to perform the double-sided printing.

In the above-described example, the image forming apparatus further includes: a third detector configured to detect the failure caused in the post processing device, wherein when the third detector outputs a detection result indicating that the failure in the post processing device occurs, the controller is configured to cause the recording sheet conveyed from the sheet discharge section to be conveyed by a transfer mechanism of the image forming apparatus without being conveyed through the finisher according to a request for performing the double-sided printing.

In another example, the present invention may reside in a method of controlling an image forming apparatus. The image forming apparatus includes: a plotter configured to perform a printing operation by forming an image on a recording sheet; a sheet discharge section configured to convey and discharge the recording sheet received from the plotter; a first switch back mechanism configured to switch back the recording sheet received from the sheet discharge section and to convey the recording sheet being switch back to the plotter when the double-sided printing is performed; and a space configured to hold the recording sheet discharged from the sheet discharge section and configured to accommodate therein a finisher when the finisher is attached to a body of the image forming apparatus. The finisher is attachable to or removable from the body of the image forming apparatus and includes: a second switch back mechanism configured to switch back the recording sheet received from the sheet discharge section and to convey the recording sheet being switch back to the plotter; and a post processing device configured to perform post processing under control of the controller of the image forming apparatus. The control method includes: controlling one of the first switch back mechanism and the second switch back mechanism so as to operate the second switch back mechanism of the finisher according to a request for performing double-sided printing when the finisher is attached to the image forming apparatus and to operate the first switch back mechanism of the finisher according to a request for performing double-sided printing when the finisher is not attached to the image forming apparatus; detecting communication failure between the image forming apparatus and the finisher to output a detection result; interrupting the printing operation and to notifying a user that the post processing operation and the double-sided printing operation are not available for use when the detection result indicating that the communication failure occurs is output.

The above-described control method further includes: detecting the failure caused in the second switch back mechanism; and notifying the user that the double-sided printing is not available for use and that the finisher needs to be removed from the image forming apparatus to perform the double-sided printing when a detection result indicating that the failure occurs in the second switch back mechanism is output.

The above-described control method further includes: detecting the failure caused in the post processing device to output a detection result; and causing the recording sheet conveyed from the sheet discharge section to be conveyed by a transfer mechanism of the image forming apparatus without being conveyed through the finisher according to a request for performing the double-sided printing when the detection result indicating that the failure in the post processing device occurs is output.

What is claimed is:

1. An image forming apparatus, comprising:

an image forming device having an image forming section at which an image is formed on at least one side of a recording sheet;

a first sheet discharge section through which the recording sheet transferred from the image forming section is output;

a first sheet discharge surface configured to discharge thereon the recording sheet output from the inside of the image forming apparatus through the first sheet discharge section;

a first switch back mechanism provided between the image forming section and the first sheet discharge section and configured to switch the direction of the recording sheet transferred through the first sheet discharge section from the direction heading to the outside of the image forming apparatus to the direction heading to the inside of the image forming apparatus;

an open space provided above the first sheet discharge surface and accommodating therein a finisher so as to cover the first sheet discharge surface when the finisher is installed onto the image forming apparatus, wherein the finisher includes:

a switch back passage configured to receive the recording sheet output from the inside of the image forming apparatus through the first sheet discharge section, and to switch back the recording sheet to the inside of the image forming apparatus through the first sheet discharge section;

a post processing passage that is separately provided from the switch back passage and configured to receive the recording sheet output from the inside of the image forming apparatus through the first sheet discharge section, and to transfer the recording sheet to a section at which post processing is applied to the recording sheet; and a second switch back mechanism provided between the first sheet discharge section of the image forming apparatus and a position at which the switch back passage and the post processing passage meet and configured to cause the recording sheet output from the first sheet discharge section to be conveyed to selected one of the switch back passage and the post processing passage according to an instruction for selecting one of the switch back passage and the post processing passage that is sent from the image forming apparatus;

a controller configured to send the instruction for selecting to the finisher to cause the second switch back mechanism of the finisher to select one of the switch back passage and the post processing passage according to a user instruction for performing an image forming job, wherein the instruction for selecting selects the post processing passage when the image forming job includes a post processing operation, and the switch back passage when the image forming job includes a double sided-printing operation; and a peripheral device controller configured to detect a communication failure between the image forming apparatus and the finisher, wherein when the communication failure is detected, the controller is configured to cause both of the post processing operation and the double-sided printing operation to be unavailable for selection by the user.

2. The image forming apparatus of claim 1, further comprising:

a second sheet discharge section separately provided from the first sheet discharge section and configured to output the recording sheet transferred from the image forming section, wherein when the communication failure is detected while the double-sided printing operation is performed according to the user instruction for performing an image forming job, the controller is configured to cause the first switch back mechanism to switch the direction of the recording sheet being transferred through the first sheet discharge section from the direction heading to the outside of the image forming apparatus to the direction heading to the inside of the image forming apparatus, to transfer the recording sheet having the direction being switched by the first switch back mechanism to the second sheet discharge section, and to output the recording sheet through the second sheet discharge section.

3. The image forming apparatus of claim 2, further comprising:

a door provided on an outer surface of the image forming apparatus and configured to expose the inside of the image forming apparatus when it is opened and to cover the inside of the image forming apparatus when it is closed; and a detector configured to detect opening or closing of the door, wherein when the communication failure is detected while the double-sided printing operation is performed, the controller is configured to interrupt the double-sided printing operation to stop transferring the recording sheet through the first sheet discharge section to the outside of the image forming apparatus, to resume the double-sided printing operation when the detector detects that the door is opened and closed, and to transfer the recording sheet having the direction being switched by the first switch back mechanism to the second sheet discharge section such that the recording sheet is output through the second sheet discharge section.

4. The image forming apparatus of claim 3, wherein when the double-sided printing operation is interrupted, the controller is configured to control operation of the first switch back mechanism to keep an edge of the recording sheet to be at a position entering the switch back passage of the finisher.

5. The image forming apparatus of claim 2, wherein the peripheral device controller is further configured to detect a switch back mechanism failure indicating that the second switch back mechanism of the finisher does not properly operate when the communication failure is not detected, and wherein when the switch back mechanism failure is detected, the controller is configured to cause both of the post processing operation and the double-sided printing operation to be unavailable for selection by the user.

6. The image forming apparatus of claim 2, wherein the peripheral device controller is further configured to detect a post processing device failure indicating that a post processing device of the finisher does not properly operate when the communication failure is not detected, and when the post processing device failure is detected while the switch back mechanism failure is not detected, the controller is configured to cause the post processing operation to be unavailable for selection by the user.

7. An image forming apparatus, comprising:

an image forming device having an image forming section at which an image is formed on at least one side of a recording sheet;

a first sheet discharge section through which the recording sheet transferred from the image forming section is output;

a first sheet discharge surface configured to discharge thereon the recording sheet output from the inside of the image forming apparatus through the first sheet discharge section;

a first switch back mechanism provided between the image forming section and the first sheet discharge section and configured to switch the direction of the recording sheet transferred through the first sheet discharge section from the direction heading to the outside of the image forming apparatus to the direction heading to the inside of the image forming apparatus;

an open space provided above the first sheet discharge surface and accommodating therein a finisher so as to cover the first sheet discharge surface when the finisher is installed onto the image forming apparatus, wherein the finisher includes:

a switch back passage configured to receive the recording sheet output from the inside of the image forming apparatus through the first sheet discharge section;

a post processing passage that is separately provided from the switch back passage and configured to receive the recording sheet output from the inside of the image forming apparatus through the first sheet discharge section; and a second switch back mechanism provided between the first sheet discharge section and a position at which the switch back passage and the post processing passage meet and configured to cause the recording sheet output from the first sheet discharge section to be conveyed to selected one of the switch back passage and the post processing passage according to an instruction for selecting one of the switch back passage and the post processing passage that is sent from the image forming apparatus;

a controller configured to send the instruction for selecting to the finisher to cause the second switch back mechanism of the finisher to select one of the switch back passage and the post processing passage according to a user instruction for performing an image forming job; and a peripheral device controller configured to detect a communication failure between the image forming apparatus and the finisher, wherein when the communication failure is detected while a double-sided printing operation is performed according to the user instruction for performing an image forming job, the controller is configured to interrupt the double-sided printing operation while making the double-sided printing operation unavailable for selection by the user and further configured to display on a display device a message suggesting the user to remove the finisher from the image forming apparatus to perform the double-sided printing operation, and to cause the double-sided printing operation to be available for selection by the user when the removal of the finisher from the image forming apparatus is detected.

8. The image forming apparatus of claim 7, wherein when the communication failure is detected, the controller is further configured to stop the supply of an electric power to the finisher.

9. A method of controlling an image forming apparatus, the method comprising:

providing the image forming apparatus having a first switch back mechanism provided between an image forming section and a first sheet discharge section of the image forming apparatus, wherein the first switch back mechanism is configured to switch the direction of a recording sheet transferred through the first sheet discharge section from the direction heading to the outside of the image forming apparatus to the direction heading to the inside of the image forming apparatus;

installing a finisher onto the image forming apparatus by accommodating the finisher in an open space provided above a first sheet discharge surface of the image forming apparatus so as to cover the first sheet discharge surface, wherein the finisher includes:

a switch back passage configured to receive the recording sheet output from the inside of the image forming apparatus through the first sheet discharge section of the image forming apparatus, and to switch back the recording sheet to the inside of the image forming apparatus through the first sheet discharge section;

a post processing passage that is separately provided from the switch back passage and configured to receive the recording sheet output from the inside of the image forming apparatus through the first sheet discharge section of the image forming apparatus, and to transfer the recording sheet to a section at which post processing is applied to the recording sheet; and a second switch back mechanism provided between the first sheet discharge section of the image forming apparatus and a position at which the switch back passage and the post processing passage meet and configured to cause the recording sheet output from the first sheet discharge section to be conveyed to selected one of the switch back passage and the post processing passage according to an instruction for selecting one of the switch back passage and the post processing passage that is sent from the image forming apparatus;

sending the instruction for selecting from the image forming apparatus to the finisher to cause the second switch back mechanism of the finisher to select one of the switch back passage and the post processing passage according to a user instruction for performing an image forming job, wherein the instruction for selecting selects the post processing passage when the image forming job includes a post processing operation, and the switch back passage when the image forming job includes a double-sided printing operation;

detecting a communication failure between the image forming apparatus and the finisher; and using a controller of the image forming apparatus to cause both of the post processing operation and the double-sided operation to be unavailable for selection by the user when the communication failure is detected.

10. The method of claim 9, further comprising:

providing a second sheet discharge section separately from the first sheet discharge section in the image forming apparatus, wherein when the communication failure is detected while the double-sided printing operation is performed according to the user instruction for performing an image forming job, the method further comprising:

causing the first switch back mechanism to switch the direction of the recording sheet being transferred through the first sheet discharge section from the direction heading to the outside of the image forming apparatus to the direction heading to the inside of the image forming apparatus;

transferring the recording sheet having the direction being switched by the first switch back mechanism to the second sheet discharge section; and outputting the recording sheet through the second sheet discharge section.

11. The method of claim 10, further comprising:

detecting opening or closing of a door provided on an outer surface of the image forming apparatus;

interrupting the double-sided printing operation to stop transferring the recording sheet through the first sheet discharge section to the outside of the image forming apparatus; and resuming the double-sided printing operation that is interrupted when detecting detects that the door is opened and closed to transfer the recording sheet having the direction being switched by the first switch back mechanism to the second sheet discharge section such that the recording sheet is output through the second sheet discharge section.

12. The method of claim 11, further comprising:

controlling operation of the first switch back mechanism when the double-sided printing operation is interrupted to keep an edge of the recording sheet to be at a position entering the switch back passage of the finisher.

13. The method of claim 10, further comprising:

detecting a switch back mechanism failure indicating that the second switch back mechanism of the finisher does not properly operate when the communication failure is not detected, wherein when the switch back mechanism failure is detected, the method further comprising:

causing both of the post processing operation and the double-sided printing operation to be unavailable for selection by the user.

14. A method of controlling an image forming apparatus, the method comprising:

providing the image forming apparatus having a first switch back mechanism provided between an image forming section and a first sheet discharge section of the image forming apparatus, wherein the first switch back mechanism is configured to switch the direction of a recording sheet transferred through the first sheet discharge section from the direction heading to the outside of the image forming apparatus to the direction heading to the inside of the image forming apparatus;

installing a finisher onto the image forming apparatus by accommodating the finisher in an open space provided above a first sheet discharge surface of the image forming apparatus so as to cover the first sheet discharge surface, wherein the finisher includes:

a switch back passage configured to receive the recording sheet output from the inside of the image forming apparatus through the first sheet discharge section of the image forming apparatus;

a post processing passage that is separately provided from the switch back passage and configured to receive the recording sheet output from the inside of the image forming apparatus through the first sheet discharge section of the image forming apparatus; and a second switch back mechanism provided between the first sheet discharge section and a position at which the switch back passage and the post processing passage meet and configured to cause the recording sheet output from the first sheet discharge section to be conveyed to selected one of the switch back passage and the post processing passage according to an instruction for selecting one of the switch back passage and the post processing passage that is sent from the image forming apparatus;

detecting a communication failure between the image forming apparatus and the finisher; and wherein when the communication failure is detected while a double-sided printing operation is performed according to the user instruction for performing an image forming job, the method further comprising:

using a controller, interrupting the double-sided printing operation while making the double-sided printing operation unavailable for selection by the user;

displaying on a display device a message suggesting the user to remove the finisher from the image forming apparatus to perform the double-sided printing operation; and causing the double-sided printing operation to be available for selection by the user when the removal of the finisher from the image forming apparatus is detected.

15. A non-transitory computer readable recording medium including computer program instructions which cause a computer to execute a method of controlling an image forming apparatus including an open space provided above a first sheet discharge surface of the image forming apparatus in which a finisher is accommodated therein so as to cover the first sheet discharge surface, wherein the image forming apparatus includes:

a first switch back mechanism provided between an image forming section and a first sheet discharge section of the image forming apparatus, wherein the first switch back mechanism is configured to switch the direction of a recording sheet transferred through the first sheet discharge section from the direction heading to the outside of the image forming apparatus to the direction heading to the inside of the image forming apparatus, and wherein the finisher includes:

a switch back passage configured to receive the recording sheet output from the inside of the image forming apparatus through the first sheet discharge section of the image forming apparatus, and to switch back the recording sheet to the inside of the image forming apparatus through the first sheet discharge section;

a post processing passage that is separately provided from the switch back passage and configured to receive the recording sheet output from the inside of the image forming apparatus through the first sheet discharge section of the image forming apparatus, and to transfer the recording sheet to a section at which post processing is applied to the recording sheet; and a second switch back mechanism provided between the first sheet discharge section of the image forming apparatus and a position at which the switch back passage and the post processing passage meet and configured to cause the recording sheet output from the first sheet discharge section to be conveyed to selected one of the switch back passage and the post processing passage according to an instruction for selecting one of the switch back passage and the post processing passage that is sent from the image forming apparatus, the method of controlling the image forming apparatus comprising:

sending the instruction for selecting from the image forming apparatus to the finisher to cause the second switch back mechanism of the finisher to select one of the switch back passage and the post processing passage according to a user instruction for performing an image forming job, wherein the instruction for selecting selects the post processing passage when the image forming job includes a post processing operation, and the switch back passage when the image forming job includes a double-sided printing operation, detecting a communication failure between the image forming apparatus and the finisher; and using a controller of the image forming apparatus to cause both of the post processing operation and the double-sided operation to be unavailable for selection by the user when the communication failure is detected.

16. The non-transitory recording medium of claim 15, wherein, when the image forming apparatus further includes a second sheet discharge section provided separately from the first sheet discharge section, and when the communication failure is detected while the double-sided printing operation is performed according to the user instruction for performing an image forming job, the method further comprises:

causing the first switch back mechanism to switch the direction of the recording sheet being transferred through the first sheet discharge section from the direction heading to the outside of the image forming apparatus to the direction heading to the inside of the image forming apparatus;

transferring the recording sheet having the direction being switched by the first switch back mechanism to the second sheet discharge section; and outputting the recording sheet through the second sheet discharge section.

17. The non-transitory recording medium of claim 16, wherein the method further comprises:

detecting opening or closing of a door provided on an outer surface of the image forming apparatus;

interrupting the double-sided printing operation to stop transferring the recording sheet through the first sheet discharge section to the outside of the image forming apparatus; and resuming the double-sided printing operation that is interrupted when detecting detects that the door is opened and closed to transfer the recording sheet having the direction being switched by the first switch back mechanism to the second sheet discharge section such that the recording sheet is output through the second sheet discharge section.

* * * * *